US005819912A

United States Patent [19]

Hou

[11] Patent Number: 5,819,912

[45] Date of Patent: Oct. 13, 1998

[54] SLIDE SELECTOR SWITCH AND INLET OUTLET DEVICE

[75] Inventor: Gary Hou, Kaohsiung, Taiwan

[73] Assignee: ITW Switches Asia Ltd., Taipei, Taiwan

[21] Appl. No.: 739,847

[22] Filed: Nov. 4, 1996

Related U.S. Application Data

[63] Continuation of Ser. No. 381,589, Jan. 31, 1995, abandoned.

[51] Int. Cl.[6] ..... H01R 13/68

[52] U.S. Cl. ..... 200/51.02; 200/296; 361/643; 439/540.1

[58] Field of Search ..... 200/547, 295, 200/296, 51.02, 51 R; 174/59; 361/643, 673; 439/540.1, 107, 651, 652, 490

[56] References Cited

U.S. PATENT DOCUMENTS

| | | | |
|---|---|---|---|
| 4,659,161 | 4/1987 | Holcomb | 439/652 X |
| 4,930,047 | 5/1990 | Peterson | 200/51 R X |
| 5,105,059 | 4/1992 | Sorenson et al. | 200/295 X |
| 5,161,997 | 11/1992 | Defibaugh et al. | 439/540.1 X |
| 5,277,620 | 1/1994 | Taylor | 439/490 |
| 5,281,155 | 1/1994 | Comerci et al. | 439/107 |
| 5,365,028 | 11/1994 | Takano | 200/547 |
| 5,484,309 | 1/1996 | Howard et al. | 439/107 X |

*Primary Examiner*—Renee S. Luebke
*Attorney, Agent, or Firm*—Schwartz & Weinrieb

[57] ABSTRACT

A slide selector switch and inlet, outlet device which can reduce cost and storage space through the integration of multiple power input and output devices is disclosed. It can be manufactured easily with less cost and can be installed quickly and conveniently by eliminating the use of screws. The structure of the device includes a slide switch having two sides provided with parallel inner walls. Each inner wall has two sides provided with parallel outer walls. An insulative plate is provided on the top of switching terminals mounted on the slide switch. A power output device is coupled to one side of the slide switch. The power output device is separated by the insulative walls which divide the device into a plurality of insertion holes. Each insertion hole is provided with an electrical contact connected to power output terminals penetrating out of the insulative wall. A power input device is formed with a cubic shape comprising a hollow portion and a plurality of power input terminals are provided inside the hollow portion. The bottom end of each power input terminal is connected to an external terminal penetrating out of a positioning hole provided at the bottom of the hollow portion.

20 Claims, 4 Drawing Sheets

SLIDE SELECTOR SWITCH AND INLET OUTLET DEVICE

This application is a continuation, of application Ser. No. 08/381,589, filed Jan. 31, 1995 and now abandoned.

FIELD OF THE INVENTION

The present invention relates to a slide selector switch device which connects a power input device to a power output device.

BACKGROUND OF THE INVENTION

Among the prior art, one slide selector switch includes a stop spring connected from the center to an actuating member, and a movable bridging contact connected across the power input end and the output end. The stop spring is used to exert a force on the bridging contact so that electrical connection can be assured. It can also be used as a sole actuating device which causes the bridging contact to generate a rotating movement. It is a drawback of the above-mentioned structure that it has limitations in convenience of use and efficiency of operation. There exists a need for a switching device which has more adaptability and broader scope of utilization.

OBJECTS OF THE INVENTION

It is therefore a primary objective of the present invention to provide a multi-functional slide selector switch device which connects a power input to a power output.

It is another objective of the present invention to provide a slide selector switch and inlet, outlet device which can reduce costs and storage space through the integration of multiple power input and output devices so as to eliminate the use of additional power input and output devices when in operation.

It is still another objective of the present invention to provide a slide selector switch device which can be manufactured easily with less cost, and can be installed quickly and conveniently by eliminating the use of screws and instead providing an elastic hook for the mounting of the device.

SUMMARY OF THE INVENTION

In accordance with the foregoing and other objectives of the present invention, a slidable selective switching device is provided. The slide selector switch and inlet, outlet device includes a slide switch having two sides provided with parallel inner walls. Each inner wall has two sides provided with parallel outer walls. An insulative plate is provided on the top of switching terminals mounted on the slidable switch. A power output device is coupled to one side of the slide switch. The power output device is separated by the insulative plate into a plurality of insertion holes, each insertion hole being provided with an electrical contact connected to power output terminals penetrating out of the insulative plate. A power input device is formed in a cubic shape with a hollow portion, and a plurality of power input terminals are provided inside the hollow portion. The bottom end of each power input terminal is connected to an external terminal penetrating out of a positioning hole provided at the bottom of the hollow portion.

BRIEF DESCRIPTION OF THE DRAWINGS

The present invention can be more fully understood by reading the subsequent detailed description of the preferred embodiment thereof and with reference made to the accompanying drawings in which like reference characters designate like or corresponding parts throughout the several views, and wherein.

DETAILED DESCRIPTION OF THE PREFERRED EMBODIMENT

Figure 3:
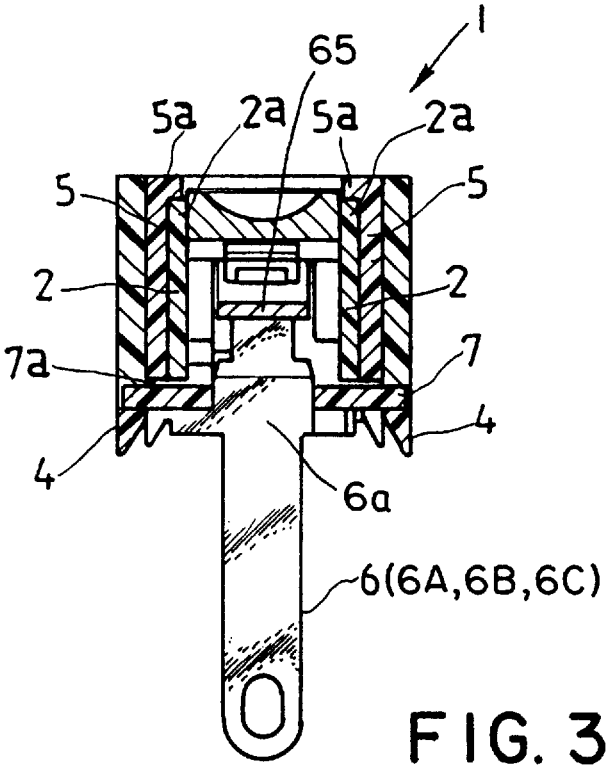
FIG. 3 is a longitudinal cross-sectional view of the preferred embodiment of the present invention.

A preferred embodiment of the present invention is shown in FIG. 3. In accordance with the present invention slide selector switch 1, which is of a type which is similar to that disclosed within U.S. Pat. No. 5,051,552, the disclosure of which is hereby incorporated herein by reference, two parallel walls 5, 5 of an inverted-L shape are provided at the left and right ends. The angled portions 5*a*, 5*a* of the two walls 5, 5 are each supported upon the shoulder portions 2*a*, 2*a* of the two inner walls 2, 2 of the slide selector switch 1 and face each other from the opposite ends. Two outer walls 4, 4 are each provided in parallel on the outward faces of the walls 5, 5. An insulative plate 7 is provided at the top portion 6*a* of a terminal 6 on the slide selector switch 1, which is used for horizontal fixation. The insulative plate 7 transversely passes through holes 7*a* provided at the bottom of the walls 5,5 so as to fix them in position. The terminal 6 can be designed in different lengths and shapes so as to be compatible with various ways of wiring, and as disclosed within the aforenoted U.S. Pat. No. 5,051,552, terminal 6 actually comprises three terminals 6A,6B,6C, similar to the terminals 32*a*,32*b*,32*c* of the aforenoted patent, for incorporation within a conventional three-terminal electrically grounded connection system as will be more fully disclosed hereinafter, the slidable or movable contact being disclosed at 6S which is similar to the slidable contact 48 of the aforenoted patent.

Figure 1:
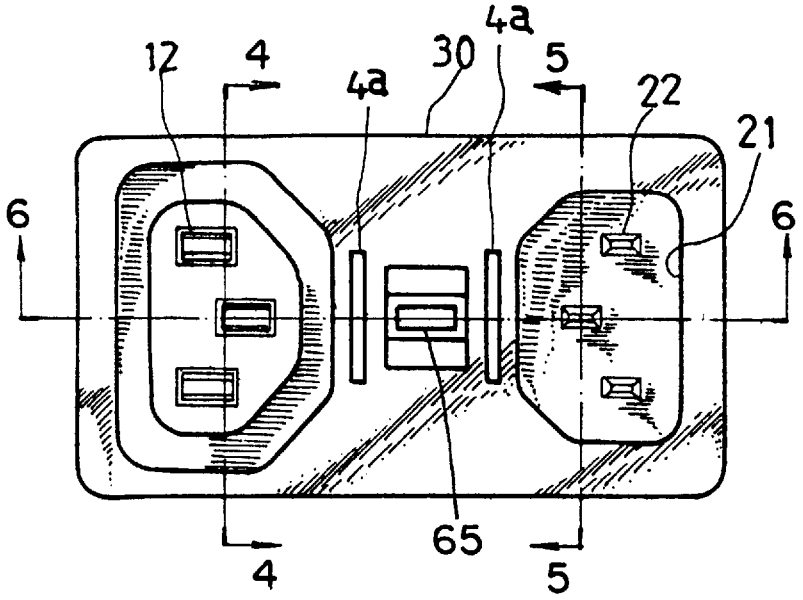
FIG. 1 is a top view of a preferred embodiment of the present invention.
Figure 2:
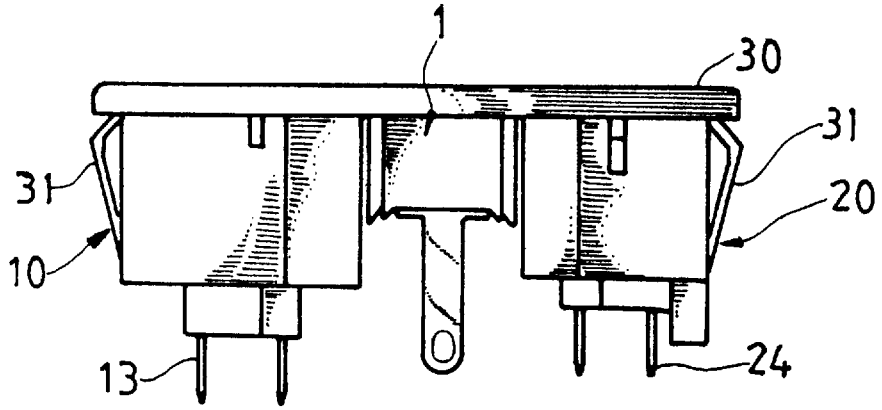
FIG. 2 is a front view of the preferred embodiment of the present invention.

Referring to FIGS. 1 and 2, since a power output device 10 and a power input device 20 are to be provided at the two opposite ends, the outer walls 4 must be manufactured in such a way that they pass through openings 4*a*,4*a* formed within the positioning plate 30 at the top of the slide selector switch device.

Figure 4:
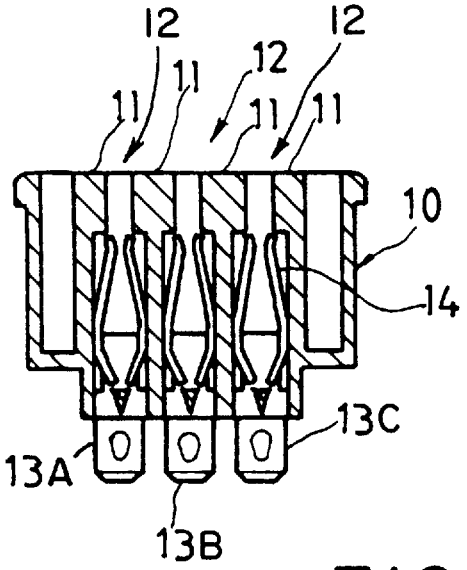
FIG. 4 is a cross-sectional view of the device of FIG. 1 cutting through the lines 4—4 4—4 in FIG. 1.
Figure 6:
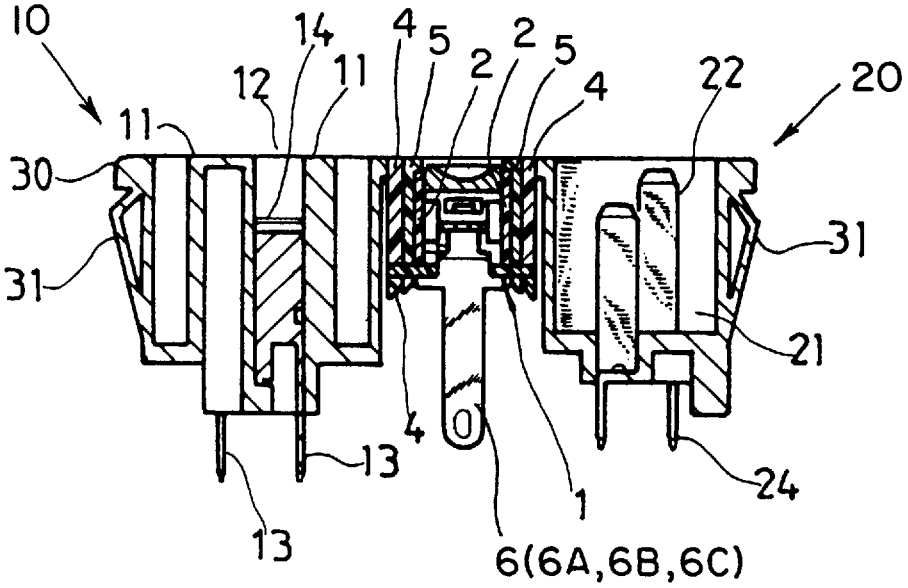
FIG. 6 is a cross-sectional view of the device of FIG. 1 cutting of the device of FIG. 1 through the lines 6—6 in FIG. 1.

Referring to FIG. 6 in conjunction with FIGS. 1 and 4, the power output device 10 is integrally provided upon the positioning plate 30 at a position which is to the left of the slide selector switch 1. The structure of the power output device 10 is shown in FIG. 4, which is provided with three insertion holes 12. A pair of electrical contacts 14 are provided in each of the insertion holes 12. The ends of the electrical contacts 14 are secured to the bottom of each insertion hole 12 and are provided with power output terminals 13. These terminals 13 can be manufactured with different shapes and lengths to be adapted to various applications, and the terminals 13 have actually been designated as terminals 13A,13B,13C as best seen in FIG. 4 for a better understanding of the electrical wiring of the invention as will be set forth hereinafter.

Figure 5:
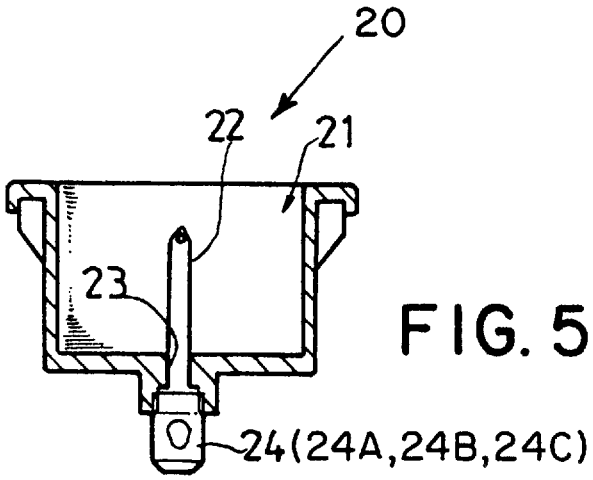
FIG. 5 is a cross-sectional view of the device of FIG. 1 cutting through the lines 5—5 in FIG. 1.

Referring to FIG. 6 in conjunction with FIG. 5, the power input device 20 is intgrally provided on the positioning plate 30 at a position which is to the right of the slide selector switch 1. The structure of the power input device 20 is shown in FIG. 5, which is formed in a cubic shape with a hollow portion 21. In this hollow portion 21, three inner terminals 22 are provided. The bottom portion of each of the inner terminals 22 is integrally formed with an outer terminal 24. Each outer terminal 24 is inserted and secured in mounting holes 23 provided at the bottom of the square hollow portion 21. The inner terminals 22 and outer terminals 24 can be manufactured with different shapes and lengths to be adapted to various applications, and the terminals 24 have actually been designated as terminals 24A, 24B,24C as best seen in FIG. 5 for a better understanding of the electrical wiring of the invention as will be set forth hereinafter.

Referring to FIGS. 2 and 6, an "<" shaped elastic hook 31 is respectively provided on the left side of the power output device 10 and on the right side of the power input device 20. The elastic hook 31 is used to mount the device of the present invention in position, which is more convenient than the conventional method that uses screws to mount the device in position. Installation is thus easy and fast.

Figure 7:
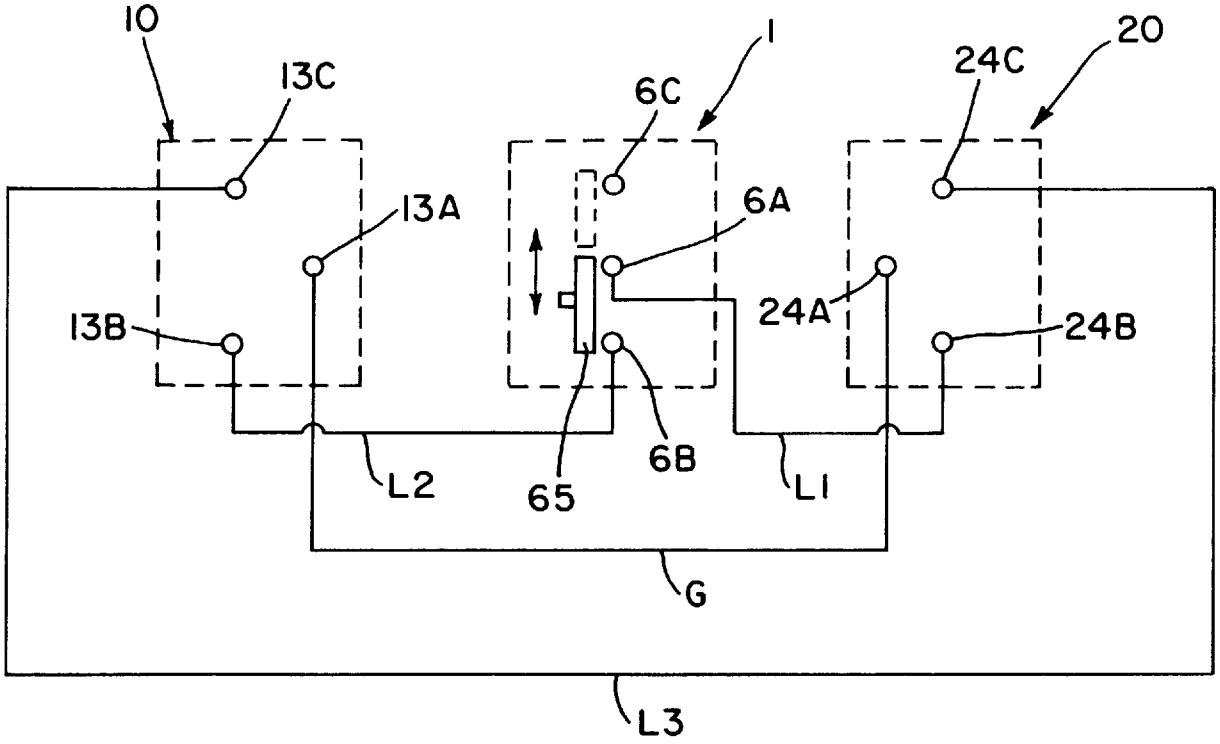
FIG. 7 is a schematic diagram of the electrical connections between the power input device, the power output device, and the slide switch.

Lastly, with respect to the actual wiring of the invention, the wiring of the same comprises electrical wiring incorporated within a three-wire electrically grounded wiring system. More particularly, as shown in FIG. 7, the fixed contacts of the switch 1 are shown at 6A,6B,6C, and the slidable contact is shown at 6S. The input terminals of input device 20 are disclosed at 24A,24B,24C, and the output terminals of output device 10 are disclosed at 13A,13B,13C. A first input terminal 24A is electrically connected to a first output terminal 13A by means of a ground connector line G, a second input terminal 24B is electrically connected to a first one of the fixed contacts 6A of the switch 1 by means of a first electrical line L1, a second output terminal 13B is electrically connected to a second one of the fixed contacts 6B of the switch 1 by means of a second electrical line L2, and a third input terminal 24C is electrically connected to a third output terminal 13C by means of a third electrical line L3.

The present invention has been described hitherto with an exemplary preferred embodiment. However, it is to be understood that the scope of the present invention need not be limited to the disclosed preferred embodiment. On the contrary, it is intended to cover various modifications and similar arrangements within the scope defined in the following appended claims. The scope of the claims should be accorded the broadest interpretation so as to encompass all such modifications and similar arrangements.

What is claimed is:

1. An assembly which includes a slide selector switch, a power input device, and a power output device, comprising:

a support plate having a substantially rectangular configuration, and comprising first and second surfaces;

said slide selector switch having a pair of parallel walls mounted upon said support plate, a slidable contact slidably disposed within said slide selector switch between said pair of parallel walls for movement between a first operative position at which said slide selector switch is closed, and a second inoperative position at which said slide selector switch is open;

said power input device, integral with said second surface of said support plate as a one-piece construction, having an end wall, comprising at least one cavity portion which extends through said support plate from said first surface to said second surface and into said power input device, and having a plurality of first electrical terminals wherein said first electrical terminals have upper ends thereof disposed within said at least one cavity portion and comprising power input terminals, and lower ends thereof projecting through said end wall of said power input device and outwardly from said power input device and comprising power output terminals; and said power output device, integral with said second surface of said support plate and said power input device as a one-piece construction, having an end wall, comprising means for dividing said power output device into a plurality of cavities, which extend through said support plate from said first surface to said second surface and into said power output device, within which are respectively provided second electrical terminals wherein said second electrical terminals have lower ends thereof projecting through said end wall of said power output device and outwardly from said power output device and comprising power output terminals, and upper ends thereof disposed within said cavities and comprising power input terminals, whereby said slide selector switch electrically interconnects said power input device to said power output device so as to provide electrical power from said power input device to said power output device when said slide selector switch is disposed at said first operative closed position.

2. An assembly as claimed in claim 1, wherein:

said pair of parallel walls of said slide switch have an inverted-L shape so as to have an angled portion thereof respectively supported upon shoulder portions of a pair of inner walls of said slide switch such that each angled portion faces each other and is disposed at the top of said slide switch.

3. An assembly as claimed in claim 2, wherein:

an insulative plate is horizontally fixed upon said slide switch and passes through holes provided within bottom portions of said parallel walls.

4. An assembly as claimed in claim 1, wherein:

said support plate is provided at the tops of said slide switch, said power output device, and said power input device, said parallel walls of said slide switch extending vertically so as to pass through openings defined within said support plate.

5. An assembly as claimed in claim 1, wherein:

each one of said upper ends of said second electrical terminals of said power output device comprises a pair of curved plates facing each other and integrally formed with said lower ends of said second electrical terminals.

6. An assembly as claimed in claim 1, wherein:

each one of said first electrical terminals of power input device has its upper end thereof integrally formed with its respective lower end thereof.

7. An assembly as claimed in claim 1, wherein:

a "<" shaped elastic hook is provided upon side portions of said power output device and said power input device for facilitating installation of said assembly within a mounting panel.

8. A slide selector switch and an inlet and an outlet assembly as set forth in claim 1, wherein:

said power input device has a substantially cubic configuration.

9. An assembly which includes a slide selector switch, a power input device, and a power output device, comprising:

a support plate having a substantially rectangular configuration, and comprising first and second surfaces;

said slide selector switch assembly fixedly mounted upon said support plate and comprising a slidable contact slidably disposed for movement between a first operative position at which said slide selector switch is closed, and a second inoperative position at which said slide selector switch is open;

said power input device, integral with said second surface of said support plate as a one-piece construction, having an end wall, comprising at least one cavity portion which extends through said support plate from said first surface to said second surface and into said power input device, and having a plurality of first electrical terminals wherein said first electrical terminals have upper ends thereof disposed within said at least one cavity portion so as to define power input terminals, and lower ends thereof projecting through said end wall of said power input device and outwardly from said power input device so as to define power output terminals; and said power output device, integral with said second surface of said support plate and said power input device as a one-piece construction, having an end wall, comprising means for dividing said power output device into a plurality of cavities, which extend through said support plate from said first surface to said second surface and into said power output device, within which are respectively disposed second electrical terminals wherein said second electrical terminals have lower ends thereof projecting through said end wall of said power output device and outwardly from said power output device and comprising power output terminals, and upper ends thereof disposed within said cavities and comprising power input terminals, whereby said slide selector switch electrically interconnects said power input device to said power output device so as to provide electrical power from said power input device to said power output device when said slide selector switch is disposed at said first operative position.

10. An assembly as set forth in claim 9, wherein:

said output device, said slide switch, and said input device are serially arranged within a longitudinal array.

11. An assembly as set forth in claim 10, wherein:

said output device and said input device are disposed upon opposite sides of said slide switch within said longitudinal array.

12. An assembly as set forth in claim 9, further comprising:

means integral with said output device and said input device for mounting said assembly within an aperture of a mounting panel.

13. An assembly as set forth in claim 12, wherein:

said mounting means comprises "<" shaped elastic hook members for snap-fittingly engaging said mounting panel.

14. An assembly as set forth in claim 9, wherein:

one of said upper ends of said second electrical terminals of said power output device comprises a pair of curved plates which together define a socket for receiving electrical contact members of an electrical connector.

15. An assembly which includes a slide selector switch, a power input device, and a power output device, comprising:

a one-piece housing comprising a support plate having a substantially rectangular configuration and comprising first and second surfaces, said slide selector switch being fixedly mounted within a substantially central portion of said support plate, said power input device being integral with said second surface of said support plate and mounted upon a first lateral side of said slide selector switch, and said power output device being integral with said second surface of said support plate and mounted upon a second lateral side of said slide selector switch;

said slide selector switch comprising a slidable contact slidably disposed for movement between a first operative position at which said slide selector switch is closed, and a second inoperative position at which said slide selector switch is open;

said power input device comprising an end wall, at least one cavity portion which extends through said support plate from said first surface to said second surface and into said sower input device, and having a plurality of first electrical terminals wherein said first electrical terminals have upper ends thereof disposed within said at least one cavity portion so as to define power input terminals and lower ends thereof projecting through said end wall of said power input device and outwardly from said power input device so as to define power output terminals; and said power output device comprising an end wall, means for dividing said power output device into a plurality of cavities, which extend through said support plate from said first surface to said second surface and into said power output device, within which are respectively disposed second electrical terminals wherein said second electrical terminals have lower ends thereof projecting through said end wall of said sower output device and outwardly from said power output device and comprising power output terminals, and upper ends thereof disposed within said cavities and comprising power input terminals, whereby said slide selector switch electrically interconnects said power input device to said power output device so as to provide, electrical power from said power input device to said power output device when said slide selector switch is disposed at said first operative position.

16. The assembly as set forth in claim 15, wherein:

said power input device, said slide switch assembly, and said power output device are serially arranged within a longitudinal array within said one-piece housing.

17. The assembly as set forth in claim 16, wherein:

said power input device and said power output device are disposed upon opposite sides of said slide switch assembly within said longitudinal array of said assembly.

18. The assembly as set forth in claim 15, further comprising:

means integral with said one-piece housing for mounting said assembly within an aperture of a mounting panel.

19. The assembly as set forth in claim 18, wherein:

said mounting means comprises "<" shaped elastic hook members mounted upon external side surfaces of said power input device and said power output device for snap-fittingly engaging said mounting panel.

20. The assembly as set forth in claim 15, wherein:

each one of said upper ends of said second electrical terminals of said power output device comprises a pair of curved plates which together define a socket for receiving an electrical contact member of an electrical connector.

* * * * *